US007467485B2

(12) United States Patent
Lachance et al.

(10) Patent No.: US 7,467,485 B2
(45) Date of Patent: Dec. 23, 2008

(54) INSERTED KNIFE FORTIFIED SNOWPLOW BLADE

(75) Inventors: Ghislain Lachance, St-Elzéar (CA); Guy Hamel, 905 Route Laurier, Ste-Croix, Quebec (CA) G0S 2H0

(73) Assignee: Guy Hamel, Ste-Croix (QC) (CA)

( * ) Notice: Subject to any disclaimer, the term of this patent is extended or adjusted under 35 U.S.C. 154(b) by 0 days.

(21) Appl. No.: 10/950,759

(22) Filed: Sep. 28, 2004

(65) Prior Publication Data

US 2006/0070264 A1 Apr. 6, 2006

(51) Int. Cl.
*E01H 5/04* (2006.01)

(52) U.S. Cl. ..... 37/232; 37/233; 37/266; 172/264

(58) Field of Classification Search ..... 37/232, 37/233, 264, 266, 451, 460, 466; 172/817, 172/261, 264
See application file for complete search history.

(56) References Cited

U.S. PATENT DOCUMENTS

| | | | | | |
|---|---|---|---|---|---|
| 1,383,409 | A * | 7/1921 | Liddell | 37/233 |
| 2,055,291 | A * | 9/1936 | Henry | 37/233 |
| 3,400,475 | A * | 9/1968 | Peitl | 37/233 |
| 3,736,664 | A * | 6/1973 | Black et al. | 37/446 |
| 3,772,803 | A * | 11/1973 | Cote | 37/233 |
| 3,864,853 | A * | 2/1975 | Klett et al. | 37/446 |
| 4,288,932 | A * | 9/1981 | Kuper | 37/233 |
| 4,669,205 | A * | 6/1987 | Smathers | 37/232 |
| 4,944,104 | A * | 7/1990 | Kowalczyk | 37/231 |
| 5,140,763 | A * | 8/1992 | Nichols, IV | 37/233 |
| 5,611,157 | A * | 3/1997 | Ferreira | 37/449 |
| 5,778,572 | A * | 7/1998 | Lukavich et al. | 37/460 |
| 5,819,443 | A * | 10/1998 | Winter | 37/233 |
| 6,094,845 | A * | 8/2000 | Lela | 37/219 |
| 2001/0005949 | A1 * | 7/2001 | Amano et al. | 37/381 |
| 2003/0221338 | A1 * | 12/2003 | Verseef | 37/266 |

* cited by examiner

*Primary Examiner*—Thomas B Will
*Assistant Examiner*—Mai T Nguyen

(57) ABSTRACT

The present invention relates to snowplow (200) systems provided with a shovel (105) utilized generally for scraping snow (106). Articulated blades (20), resembling a hand (21) having a Y or a H shape, wherein wear knives (22) are inserted and locked in place between twin blades (23), by particular means of retention, permitting to increase the longevity of the blades during frequent passages over altered roads. The blades are provided also with a skate (129) system at an attack corner (139) preventing the breaking of the blade and allowing the blade to follow the irregularities of the road. The blades are installed lengthwise along the snowplow.

2 Claims, 10 Drawing Sheets

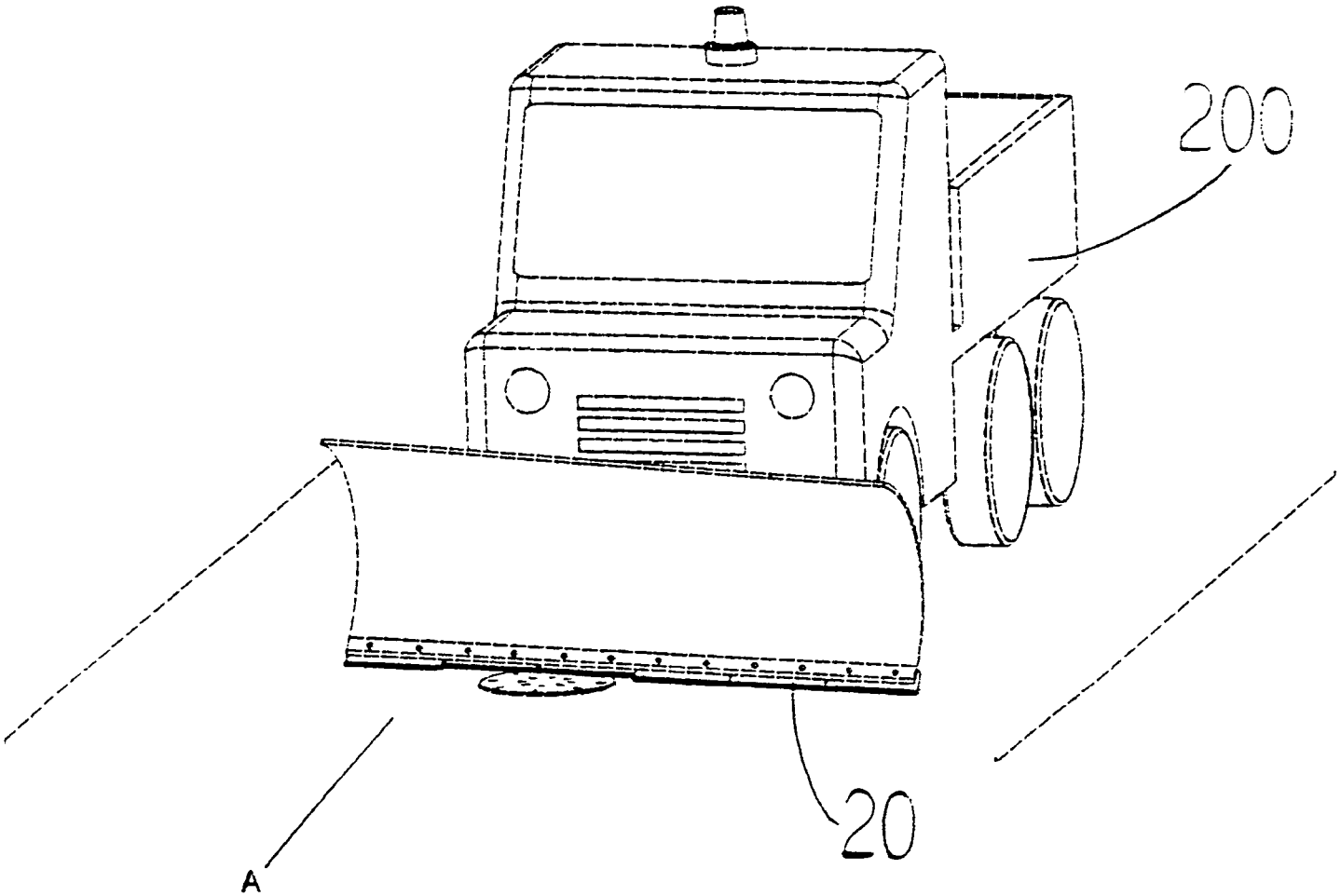
ART ANTE FIG.5

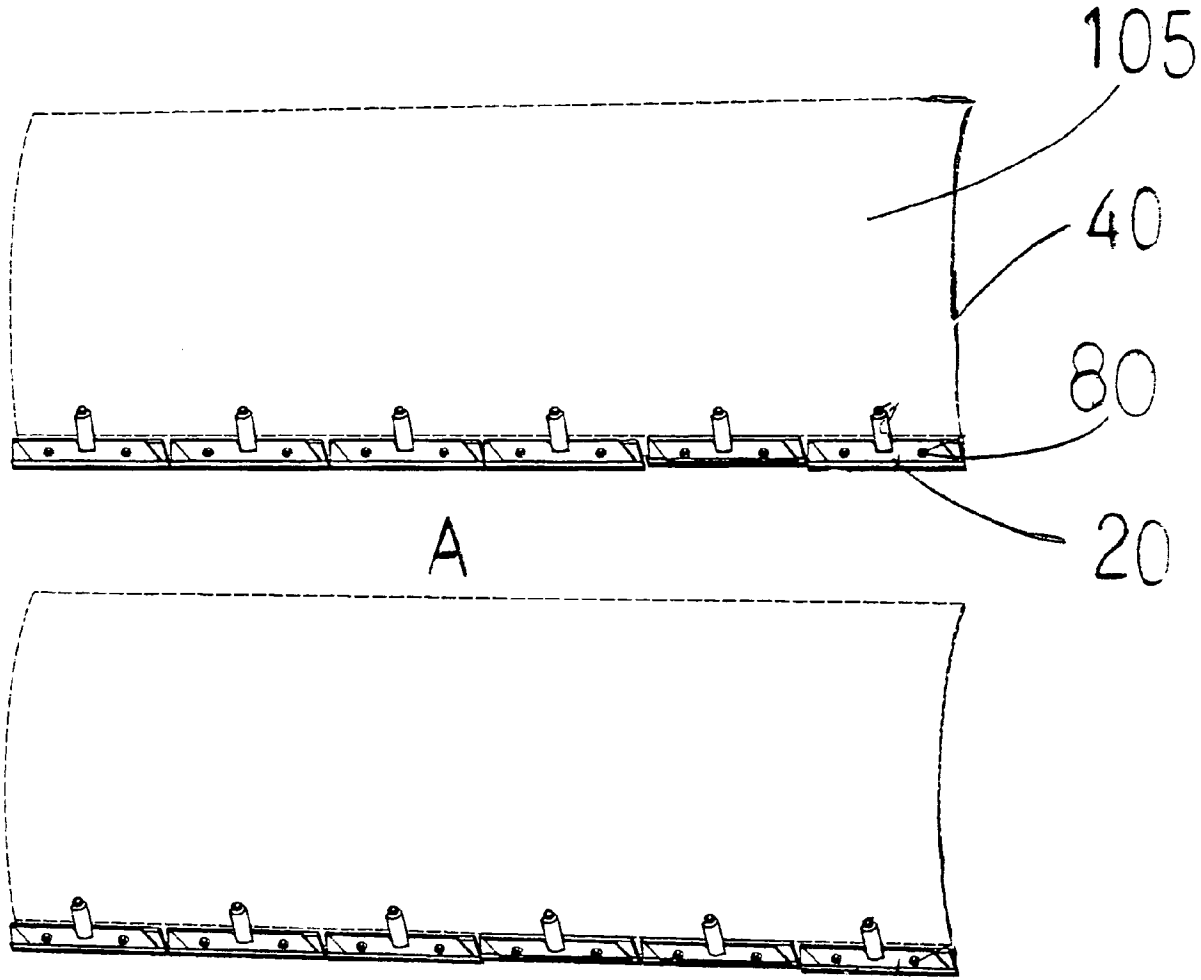
ART ANTE FIG.6

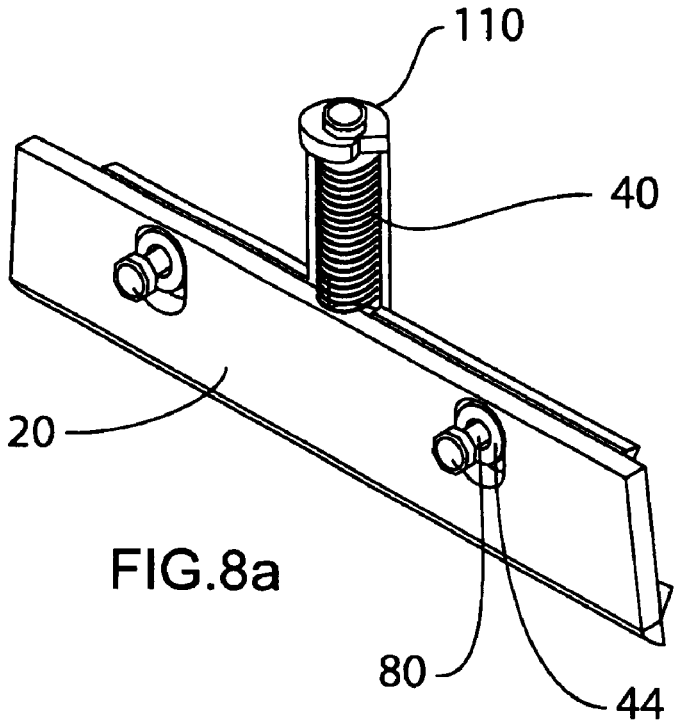
FIG.8a
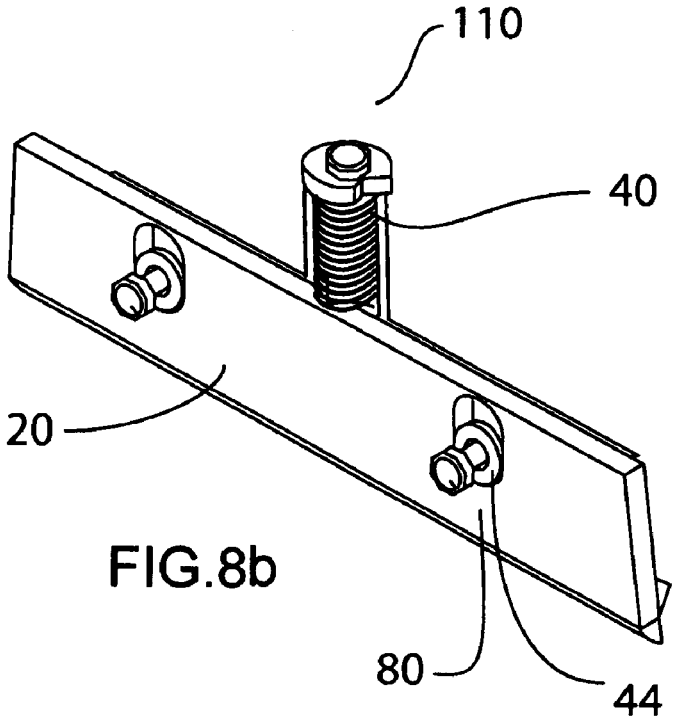
FIG.8b
FIG.8

INSERTED KNIFE FORTIFIED SNOWPLOW BLADE

BACKGROUND

1. Field of Invention

This invention relates to the field of snowplow with articulated blades, provided with fortified knives inserted and maintained in place into the blades to offer a greater durability during passages over altered roads in frequent uses. This patent proposes a modification to the blade to increase the resistance by providing a complete system of inserted wear knives replacing the known thin carbides and by also offering a device preventing blades from breaking up, by providing a skate mean for the sake of a fluid deflection of snow.

This invention belongs to the maintenance of the road system particularly the ones using snowplow, and particularly snowplow provided with articulated blades for scraping the snow by means of blades containing fortified wear knives inserted and locked in place by particular means of retention inside. This patent proposes a modification to the blade to increase the durability and the quality of the snow removal and to diminish the use of salt and sand used for removing ice on roads particularly on altered and damaged roads revealing difficulty in cleaning.

Furthermore, the invention comprises a modification to a blade by offering a mean of skate gauging the depth of the blade movement permitting the articulated blade to follow the irregularities of altered roads.

2. Description of the Prior Art

The present invention is an improvement over an invention from one of the present inventors so being utilized by other articulated snowplow scraper comprising some of the present characteristics: namely an articulated. The prior patent from one of the present inventors refers to the following:

CA 2,423,830; Articulated scraper blade system.

Other searches of the prior art revealed the following patents:

U.S. Pat. No. 2,282,298; Vogel, 1942
CA 2,242,278; Daniels, 1998
U.S. Pat. No. 5,865,997; Isaacs, 1997
U.S. Pat. No. 3,906,577; Brucher, 1973
FR 2,539,438; Kueper, 1984
U.S. Pat. No. 4,258,797; Mckenzie, 1978

The patents seen do not offer the same particularities as the present invention: wherein an articulated blade system provided with fortified knives and a skate mean increasing the durability and preventing the blade break during frequent passages on altered roads fulfilled with holes.

OBJECTIVES

In use the removal of snow on the road system is effectuated by means of a snowplow provided with at least a shovel comprising a scraper blade and sometimes articulated blades which the invention refers to. The articulated blades can be provided with fortified inserted knives increasing resistance according to their hardness, determined by the material used in their conception. The articulated blades move slightly vertically to adapt to the irregularities of altered roads by means of shock absorbers. The pressure of the snow and the abrasion against the road surface increase correspondently while the snowplow moves and removes the snow. The snow removal depends then on the quality of the material used in the conception, particularly in the blade quality and the assembly of the components. The advantages of the present invention lie in the method of inserting wear knives between two blades, so to lock the knives in place, to prolong the life expectancy and the durability of the blades.

These knives being made of a more resistant alloy composition than the blades themselves limit and slow down the wear. The knives endorse the wear, when positioned between blades, touching the ground at the same level as the blades themselves. Furthermore, comparatively to the prior invention a thickened conception of the blades and the knives replacing the prior thin carbide contribute equally to increase a durability of the device. The inserted knives in the blades are maintained in place by means of retention as notches or catches and hems similar to small excrescences and a side retaining plate to prevent the release of the knives from their locked position in the blades and limiting their movement. As well, another important modification intervenes by incorporating means for preventing the breaking up of the blade, by installing skate means at an attack corner being more exposed slightly at the front, during passages over declivities, avoiding the blade digging a the road way and letting slide the blade following irregularities of the same road ways. The articulated blades are moved vertically according to the rolling of the road by means of shock absorbers disposed on each blade and mounted on a shovel by attach means. The sliding of the blades procured by means of a skate preventing the digging of the blades into the road is preferably molded at the attack corner of each blade but could be placed in another location on the blade or could be added to the blade as a separate piece.

This device is casual but nevertheless not essential and does not limit the invention; the blades provided with fortified knives could be used without the intake of the shock absorbers neither the skate means but only used by itself: the fortified knives inserted into the blades.

BRIEF DESCRIPTION OF THE DRAWINGS

The present invention will be further understood from the following description with reference to the drawings in which:

FIG. 5 is a view of the prior art showing a snowplow.

FIG. 6A-6B are views of the prior art showing a shovel.

FIG. 8A is a view of FIG. 7.A the rear being in upward position.

FIG. 8B. is a view of FIG. 7.A the rear being in downward position.

DESCRIPTION OF THE PREFERRED EMBODIMENT

Preferred embodiments of the invention are illustrated in the figures wherein the same numbers identify the same characterizing elements.

Figure 1:
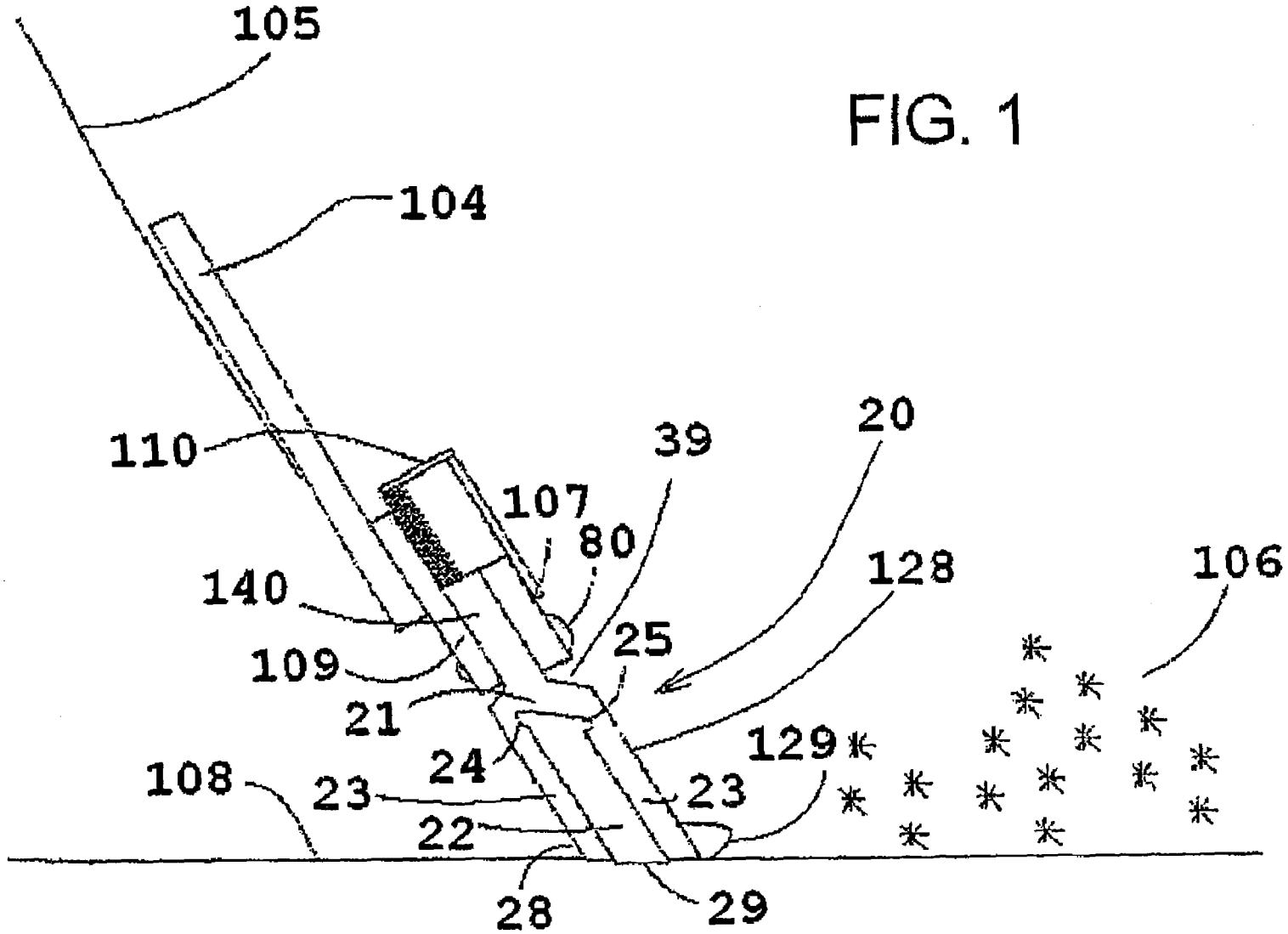
FIG. 1 is a side view of the device in action.

FIG. 1, shows a snowplow shovel 105 wherein is fixed a shovel plate 104 provided with a front support 107 and with a rear support 109; in between is inserted an articulated blade 20 held by an attach 80 fixed to the supports 107-109 and to the shovel plate 104. One sees the blade overhung by a shock absorber 40 permitting a slightly vertical movement, the shock absorber being held by a seat 110. One sees also the blade resembling a hand 21 having two twin blades 23 and an inclined part 29. The twin blades integrate a wear knife 22 comprising a rear hem 24 and a front hem 25 fixing the knives into the blade at a front notch 125 of FIG. 2A opposite the front hem and at a rear notch 124 of FIG. 2A opposite the rear hem; the knife comprises also an excess 29. The blade comprises a front inferior face 128 and a skate 129 meant to help the following of irregularities of the road while the blade is pushed downward by the shock absorber. The blades and the knives touch the road 108 to remove the snow 106.

Figure 2B:
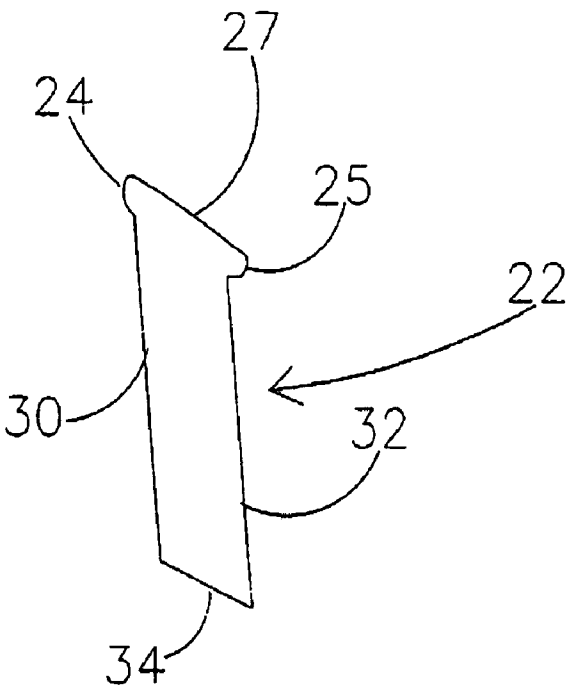
FIG. 2B is a side view of the knife.
Figure 2A:
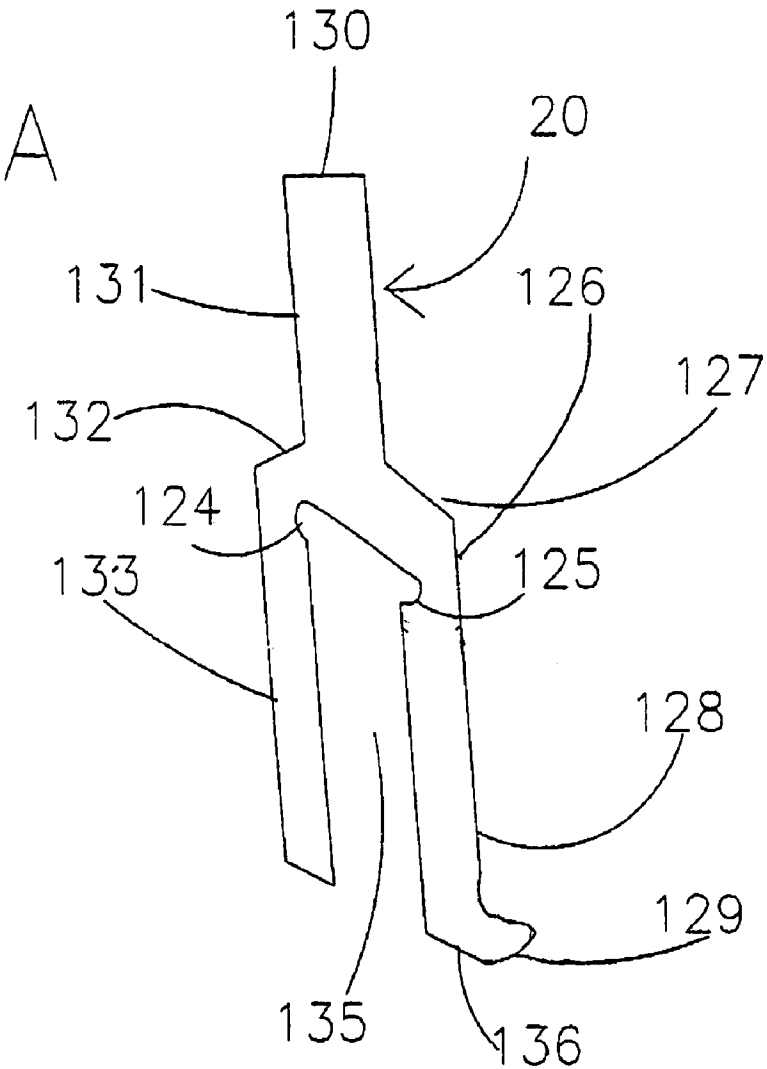
FIG. 2A is a side view of a blade with an inversed Y structure.

FIG. 2A shows a blade 20 comprising a front superior face 126, an inclined front face 127, a front inferior face 128, a skate 129, a blade top 130, a rear superior face 131, an inclined rear face 132, a rear inferior face 133 and a blade bottom 136. The blade comprises also an interior 135 serving to insert the wear knife 22 of FIG. 2B, a front notch 125 and a rear notch 124 retain the wear knife of the following figure.

FIG. 2B shows a wear knife 22 comprising a knife front 32, a knife back 30, a knife foot 34, and a knife head 27, a front hem 25 and a rear hem 24; both serving to retain the knives for they are inserted in the two notches of the blade.

Figure 2D:
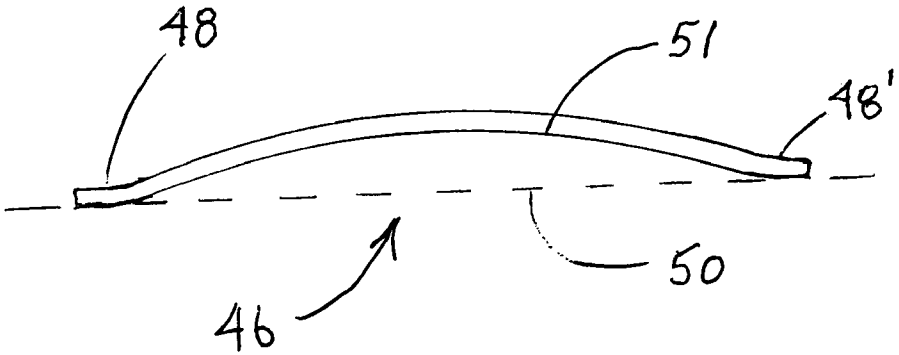
FIG. 2D is a side view of a leaf spring 51 of FIG. 2C.
Figure 2C:
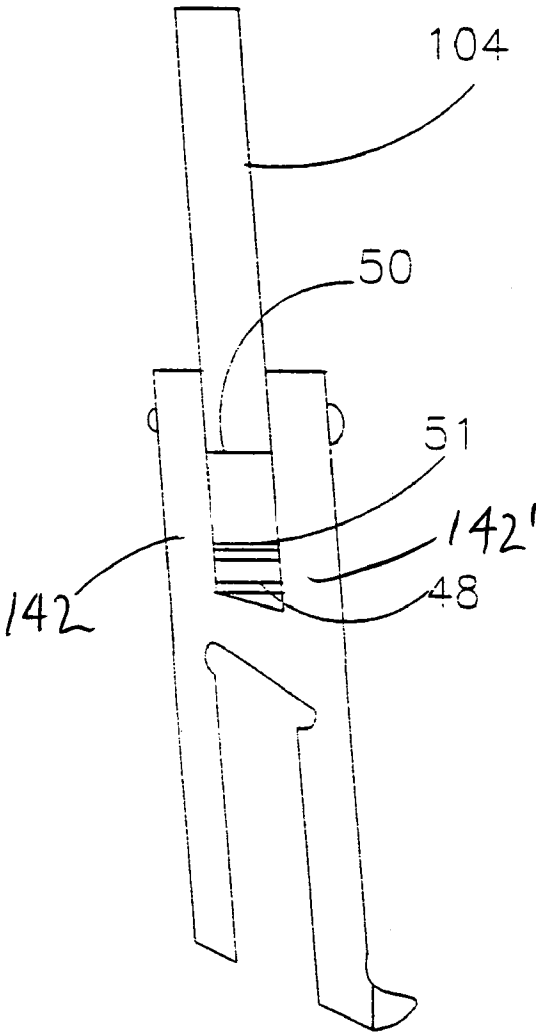
FIG. 2C is a side view of the blade with a H-like structure.

FIG. 2C shows a shovel plate 104 housed in a female part defining the upper part of a H design, the upper part thereof having the appearance Of a reversed U 142. In this upper part is positioned a blade spring end 48 which may move up and down between a maximal ark 50 and a minimal ark 51.

FIG. 2D shows a blade spring 46 laid out showing its full length.

Figure 3D:
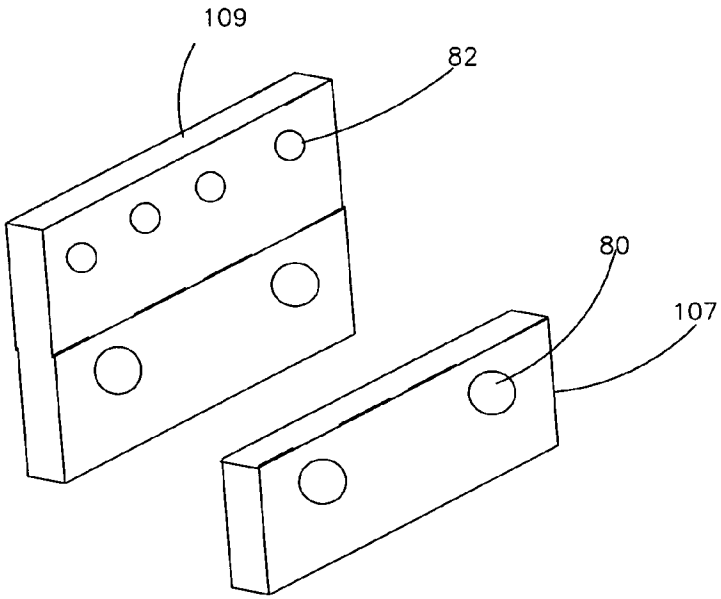
FIG. 3D shows a perspective of the blade support.
Figure 3A:
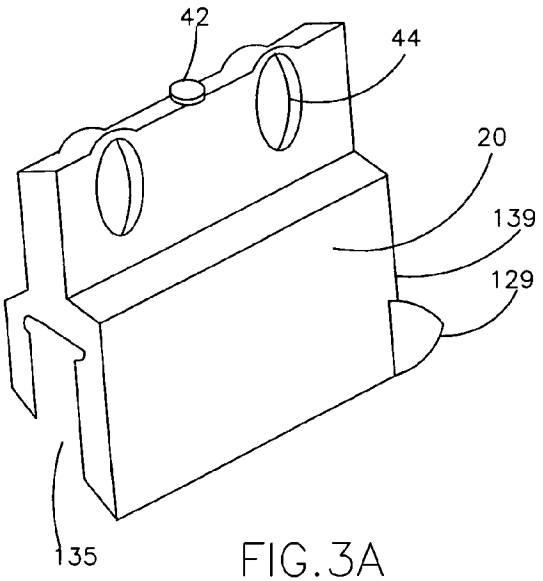
FIG. 3A shows a perspective of the blade.

FIG. 3A shows a blade 20 comprising holes 44 permitting the slightly vertical movement of the blade, one sees also a shock absorber axes 42, the blade interior 135 and the skate 129 on a blade attack corner 139.

Figure 3B:
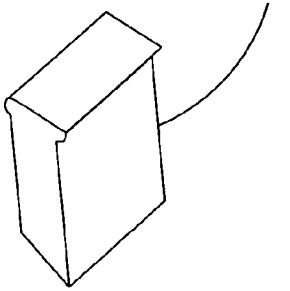
FIG. 3B shows a perspective of the knife.

FIG. 3B shows a rear knife 22.

Figure 3C:
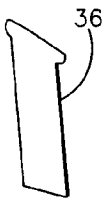
FIG. 3C shows a perspective of the plate.

FIG. 3C shows a retaining plate 36 meant to lock in place the knife in the blade interior so to seal tight the aperture of the blade interior once the knives are inserted.

FIG. 3D shows a front support 107 an a rear support 109 positioned on each side of the blades for maintaining the blades in place against the snowplow plate 104 shown in FIG. 1, by attach means 80 and support attach 82.

Figure 4:
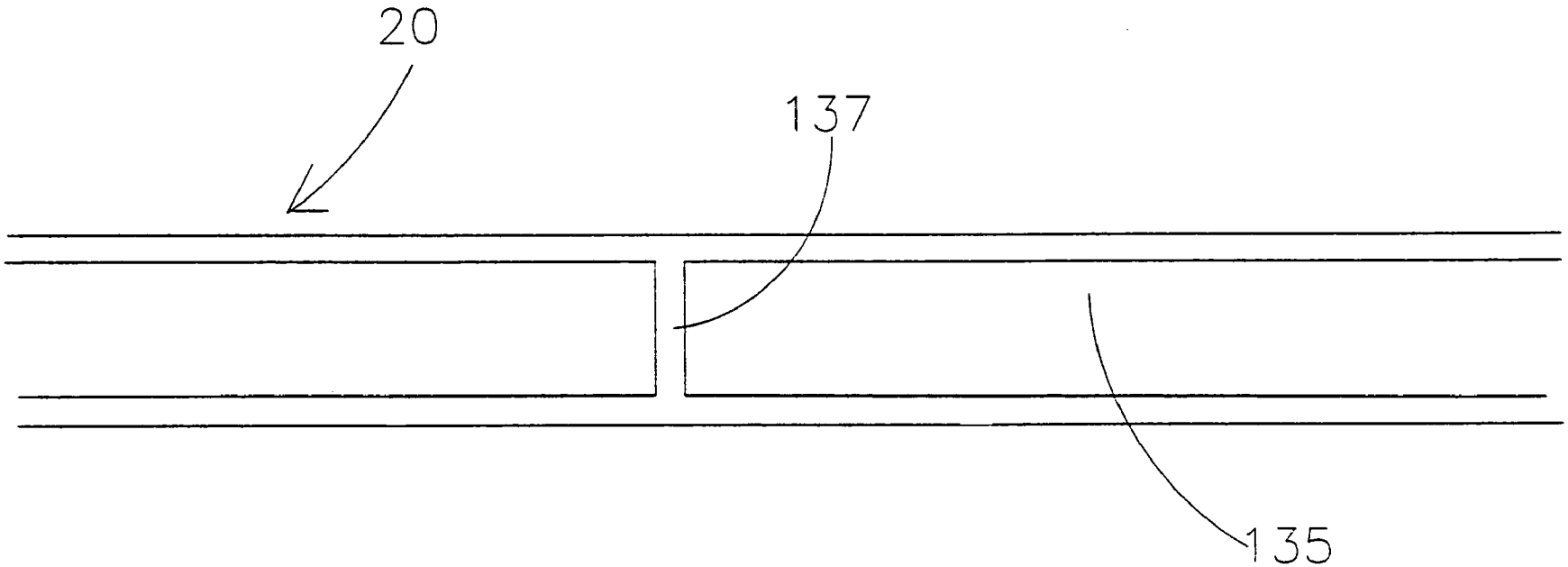
FIG. 4 is a bottom view of the blade showing the inside.

FIG. 4 shows a blade 20 comprising a blade interior 135 and a knife separator 137.

FIG. 5 shows a snowplow 200 provided with an articulated blade device 20.

FIG. 6A-6B shows a snowplow shovel 105 and an articulated blade device 20, provided with a shock absorber 40 and attach means 80.

Figure 7A:
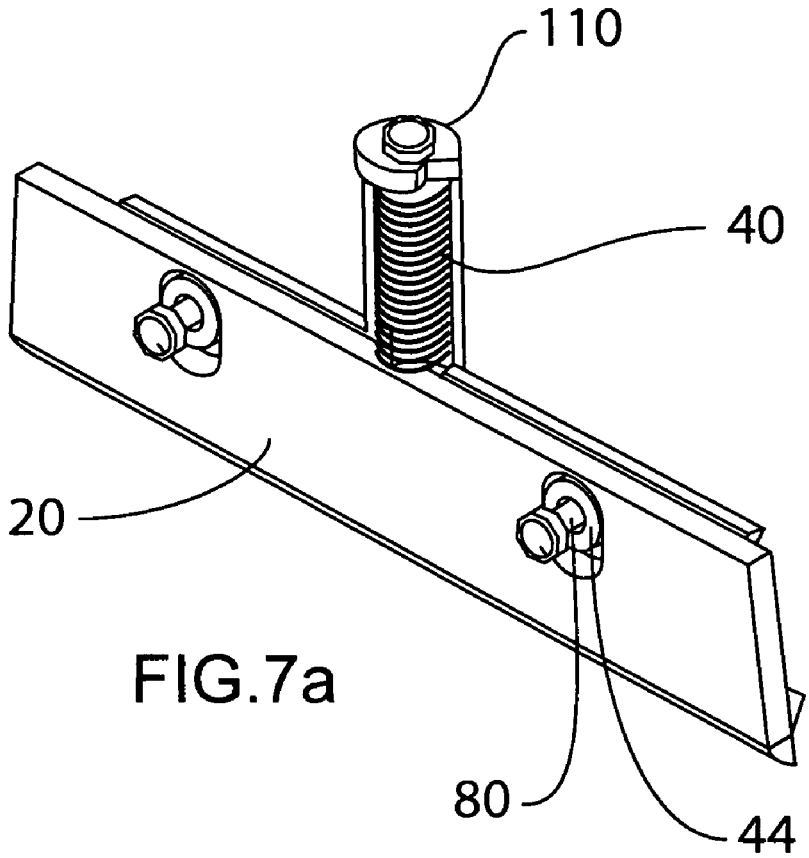
FIG. 7A is a view of the prior art seen from the back.
Figure 7B:
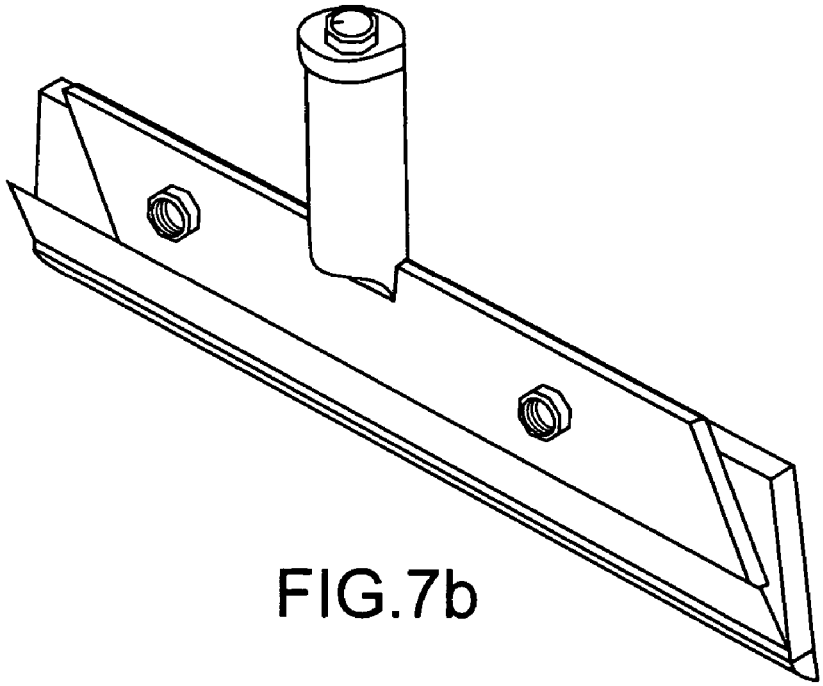
FIG. 7B is a view of the prior art seen from the front.

FIG. 7A-7B shows an articulated blade device 20 provided with a shock absorber 40 and a shock absorber seat 110, furnished also of holes 44 which pass attaches 80.

FIG. 8A-8B shows in use the vertical movement of the articulated blade 20 in its upward and downward positions, in the upward position the spring being compressed.

Figure 9:
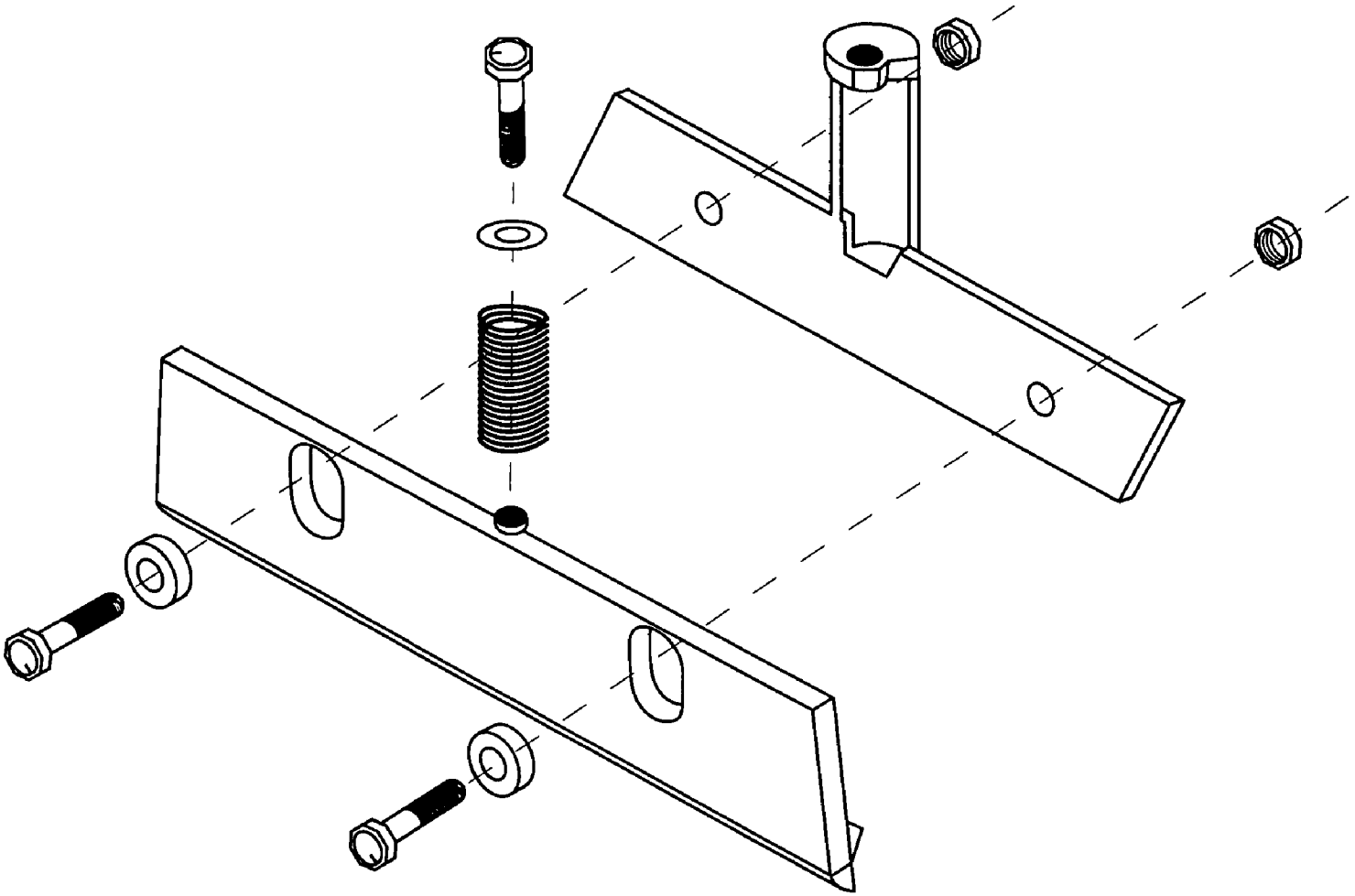
FIG. 9 is an exploded view of the prior art showing the device.

FIG. 9 shows an embodiment comprising the preferred components mentioned above.

SUMMARY

A snowplow shovel 105 provided with at least a blade 20 comprising; at least a hand 21 in U, comprising a blade interior 135 creating twin blades 23, 23' and an adapted part 140 to the shovel, at least a wear knife 22 fortified, inserted in the interior blade 135, means of retention of the knives to the blades 23 in a way so the knives take preferably the wear instead of the blades.

The blade 20 is articulated and the means of retention comprise; at least means of notching 125, 124, in a hand 21, the knife comprises means of hem 25, 24 meant to insert and lock in place the knife correspondingly to the blade interior.

The articulated blade may have an attack corner 139 comprising at least a skate 129.

A snowplow shovel comprises at least one articulated blade 20 having a hand in U 21 moving along a shock absorber 40 on an inclined part 28 following the irregularities of the road to clean, the shock absorber being either hydraulic, mechanical or pneumatic; the hand in U comprises at least a knife 22 blade comprising support means 107, 109, and means of at least an attach 80 to the snowplow shovel 105 or to snowplow plate (104) mounted on the snowplow.

In the articulated blade the blade interior is of at least ¼" thick and up.

The knife is at least of ¼" thick and up and is inserted into the blade, knife could be of infinite sizes as long as it corresponds to the size of the blade interior. The blade is closed once the knife is inserted by means of a plate. The blade comprises a shock absorber which permits a slight vertical movement, slightly inclined to follow the irregularities of the road to clean.

The shock absorber may be of various types, hydraulic, mechanical and pneumatic.

A method to improve the durability of snowplows provided with at least a blade and a wear knife, the method comporting at least the following step:

Create at least an open interior 135 into a blade opposite a wear knife to let it enter and then lock it in place by retention means, the blade grabbing the knife as a hand.

A snowplow shovel 105 provided with at least a blade, the blade being provided with a front inferior face 128 disposed beyond a front superior face 126 on which is positioned a front support 107 producing a thickness differential 39 generating snow deflection.

The blade 20 has a thickness differential 39 of a ¼" to ½".

The blade has an excess 29 of 0 to ¼".

In a snowplow shovel 105 a shock absorber 40 is a leaf spring 46 placed longitudinally on an inclined plane 28, the hand in U comprising oppositely a U adapted to insert a knife, a second U meant to act as a sheath to receive a shovel plate 104.

An adapted part 140 has an I shape 141, support means 109,107 being exposed externally to the I. The I may be disposed in continuation along the blades 23, 23' defining the hand 21 as an L shape. The adapted part 140 may have a H shape 142, a shovel plate 104 being inserted into the H shape 142, the H shape being the result of a reversed U attach to the wear knife 22 and of a straight U attach to the shovel plate 104 superposed to the reversed U.

It is well accepted that the embodiment of the present invention which was described above, in reference to the matched drawings, was given indicatively and certainly not limitative, and that modifications and adaptations could be brought without moving away from the object of the present invention. Other embodiments are possible and limited only by the scope of the appended claims.

LEGEND

20—Articulated blade
21—Hand
22—Wear knife
23—Twins blades
24—Rear hem
25—Front hem
27—Knife head
28—Inclined part
29—Excess
30—Knife back
32—Knife front
34—Knife foot
36—Retaining plate
38—Blade point
39—Thickness differential
40—Shock absorber
41—Compressed spring
42—Shock absorber axis
44—Holes
46—Blades springs
48—Blades springs end
50—Maximum ark
51—Minimum ark
80—Attach
82—Attach support
104'Shovel plate
105—Snowplow shovel
106—Snow
107—Front support
108—Road
109—Rear support
110—Shock absorber seat
124—Rear notch
125—Front notch
126—Front superior face
127—Inclined front face
128—Front inferior face
129—Skate
130—Blade top
131—Rear superior face
132—Inclined rear face
133—Rear inferior face
135—Blade interior
136—Blade bottom
137—Knife separator
139—Blade attack corner
140—Adapted part
141—Straight I
142—Reversed U
200—Snowplow

We claim:

1. A snowplow shovel (105) provided with at least an articulated blade (20) comprising:

an adapted part (140) movably connecting to said shovel and having twin blades (23, 23') defining a blade interior (135) therebetween, at least one wear knife (22) fortified, inserted in said blade interior (135), means for retaining said at least one wear knife to said blades (23, 23') in a way that said wear knife is in contact with the ground and snow before said blades, said adapted part moves vertically so that it remains parallel to the ground; said adapted part (140) is an upside down Y-shape part (21) having a shank thereof and legs thereof being made of said twin blades with said wear knife inserted therebetween and said shank being enclosed in between a front support (107) and a rear support (109) and comprising attaches (80), to move up and down along inclined part (28) acting as a shock absorber (40) following irregularities of a snow or ice covered road, and said shock absorber (40) is a blade spring (46) placed longitudinally on said inclined part (28), said upside down Y shape part (21) having a shank defining an upwardly positioned U shape part oppositely to an upside down U meant to insert the wear knife, said shank being a second U meant to act as a sheath to receive a shovel plate (104).

2. A snowplow shovel (105) provided with at least an articulated blade (20) comprising:

an adapted part (140) movably connecting to said shovel and having twin blades (23, 23') defining a blade interior (135) therebetween, at least one wear knife (22) fortified, inserted in said blade interior (135), means for retaining said at least one wear knife to said blades (23, 23') in a way that said wear knife is in contact with the ground and snow before said blades, said adapted part moving vertically so that it remains parallel to the ground; said adapted part (140) of said blade (20), having a "H" shape (142), a shovel plate (104) being inserted into said "H" shape (142), said "H" shape being the result of a reversed U attached to said wear knife (22) and of a straight U attached to said shovel plate (104) superposed to said reversed U.

* * * * *